US009932974B2

(12) United States Patent
Sprouse

(10) Patent No.: US 9,932,974 B2
(45) Date of Patent: Apr. 3, 2018

(54) DUCT HAVING OSCILLATORY SIDE WALL

(71) Applicant: Gas Technology Institute, Des Plaines, IL (US)

(72) Inventor: Kenneth M. Sprouse, Sacramento, CA (US)

(73) Assignee: Gas Technology Institute, Des Plaines, IL (US)

( * ) Notice: Subject to any disclaimer, the term of this patent is extended or adjusted under 35 U.S.C. 154(b) by 645 days.

(21) Appl. No.: 14/296,761

(22) Filed: Jun. 5, 2014

(65) Prior Publication Data

US 2015/0353284 A1 Dec. 10, 2015

(51) Int. Cl.
*F04B 19/20* (2006.01)
*F04B 19/24* (2006.01)

(52) U.S. Cl.
CPC ..... *F04B 19/20* (2013.01); *F04B 19/24* (2013.01)

(58) Field of Classification Search
CPC ..... F04B 19/20; F04B 19/24; F23G 5/444
USPC ..... 417/430
See application file for complete search history.

(56) References Cited

U.S. PATENT DOCUMENTS 1,011,589 A 12/1911 Curtis
3,245,517 A 4/1966 Ward
3,785,969 A * 1/1974 Molls ..... B01D 29/356 210/414
3,844,398 A 10/1974 Pinat
3,856,658 A 12/1974 Wolk et al.
3,950,147 A 4/1976 Funk et al.
4,044,904 A * 8/1977 Trumbull ..... B01J 3/02 201/6
4,069,911 A 1/1978 Ray
4,071,151 A * 1/1978 Farber ..... B01J 3/02 202/262
4,148,405 A * 4/1979 Hathaway ..... C10J 3/30 414/207
4,191,500 A 3/1980 Oberg et al.
4,197,092 A 4/1980 Bretz
4,206,610 A 6/1980 Santhanam
4,206,713 A 6/1980 Ryason
4,218,222 A 8/1980 Nolan, Jr. et al.
4,356,078 A 10/1982 Heavin et al.
4,377,356 A 3/1983 Santhanam
4,391,561 A 7/1983 Smith et al.
4,433,947 A 2/1984 Kratzer et al.
4,453,866 A * 6/1984 Ryan ..... B65G 53/40 111/34
4,488,838 A 12/1984 Herud
(Continued)

FOREIGN PATENT DOCUMENTS

DE 1 949 678 11/1966
DE 32 17 414 C1 7/1983
(Continued)

*Primary Examiner* — Devon Kramer
*Assistant Examiner* — Joseph Herrmann
(74) *Attorney, Agent, or Firm* — Pauley Erickson & Kottis

(57) ABSTRACT

A pump system includes a particulate consolidator pump that has a pump outlet. A duct is coupled to the pump outlet. The duct has a wall that is coupled with an oscillator. The oscillator is operable to oscillate the wall at a controlled frequency. The controlled frequency is selected with respect to breaking static bridging of particulate in the duct due, at least in part, to consolidation of the particulate from a downstream check valve.

15 Claims, 4 Drawing Sheets

(56) References Cited

U.S. PATENT DOCUMENTS

| | | | | |
|---|---|---|---|---|
| 4,516,674 | A | 5/1985 | Firth | |
| 4,605,352 | A | 8/1986 | Scott et al. | |
| 4,611,646 | A | 9/1986 | Wassmer et al. | |
| 4,721,420 | A | 1/1988 | Santhanam et al. | |
| 4,765,781 | A | 8/1988 | Wilks et al. | |
| 4,963,065 | A | 10/1990 | Scott et al. | |
| 4,988,239 | A | 1/1991 | Firth | |
| 5,051,041 | A | 9/1991 | Firth | |
| 5,094,340 | A | 3/1992 | Avakov | |
| 5,186,111 | A | 2/1993 | Baria | |
| 5,273,556 | A | 12/1993 | McMahon et al. | |
| 5,325,603 | A | 7/1994 | Eastham et al. | |
| 5,340,241 | A * | 8/1994 | Thiele | B65G 53/46 251/147 |
| 5,402,876 | A | 4/1995 | Hay | |
| 5,435,433 | A | 7/1995 | Jordan et al. | |
| 5,485,909 | A | 1/1996 | Hay | |
| 5,492,216 | A | 2/1996 | McCoy et al. | |
| 5,497,873 | A | 3/1996 | Hay | |
| 5,533,650 | A | 7/1996 | Conrad et al. | |
| 5,551,553 | A | 9/1996 | Hay | |
| 5,558,473 | A | 9/1996 | Lindahl | |
| 6,152,668 | A | 11/2000 | Knoch | |
| 6,213,289 | B1 | 4/2001 | Hay et al. | |
| 6,220,790 | B1 | 4/2001 | Schenk et al. | |
| 6,257,567 | B1 | 7/2001 | Hansmann et al. | |
| 6,296,110 | B1 | 10/2001 | van Zijderveld et al. | |
| 6,533,104 | B1 | 3/2003 | Starlinger-Huemer et al. | |
| 6,670,404 | B2 * | 12/2003 | Martel | B02C 4/04 521/155 |
| 6,749,816 | B1 | 6/2004 | Hasegawa et al. | |
| 6,875,697 | B2 | 4/2005 | Trivedi | |
| 6,920,836 | B2 | 7/2005 | Sprouse | |
| 7,303,597 | B2 | 12/2007 | Sprouse et al. | |
| 7,360,639 | B2 | 4/2008 | Sprouse et al. | |
| 7,387,197 | B2 * | 6/2008 | Sprouse | F04D 33/00 198/497 |
| 7,402,188 | B2 | 7/2008 | Sprouse | |
| 7,547,423 | B2 | 6/2009 | Sprouse et al. | |
| 7,615,198 | B2 | 11/2009 | Sprouse et al. | |
| 7,717,046 | B2 | 5/2010 | Sprouse et al. | |
| 7,740,672 | B2 | 6/2010 | Sprouse | |
| 8,006,827 | B2 | 8/2011 | Aldred et al. | |
| 8,011,187 | B2 | 9/2011 | Sprouse et al. | |
| 8,011,861 | B2 | 9/2011 | Sprouse et al. | |
| RE42,844 | E | 10/2011 | Sprouse et al. | |
| 8,196,848 | B2 | 6/2012 | Sprouse et al. | |
| 8,231,068 | B2 | 7/2012 | Sprouse et al. | |
| 8,308,829 | B1 | 11/2012 | Sprouse et al. | |
| 8,631,927 | B2 | 1/2014 | Saunders et al. | |
| 8,662,408 | B2 | 3/2014 | Stevenson et al. | |
| 8,663,348 | B2 | 3/2014 | Sprouse et al. | |
| 8,673,234 | B2 | 3/2014 | Yows et al. | |
| 8,685,120 | B2 | 4/2014 | Sprouse et al. | |
| 8,721,747 | B2 | 5/2014 | Sprouse et al. | |
| 2006/0242907 | A1 | 11/2006 | Sprouse et al. | |
| 2006/0243583 | A1 | 11/2006 | Sprouse et al. | |
| 2011/0247916 | A1 | 10/2011 | Fitzsimmons | |
| 2011/0247919 | A1 * | 10/2011 | Fitzsimmons | F04B 19/20 198/626.1 |
| 2012/0048408 | A1 * | 3/2012 | Saunders | F23K 3/00 137/565.17 |
| 2012/0321444 | A1 * | 12/2012 | Sonwane | F23G 5/444 415/121.1 |

FOREIGN PATENT DOCUMENTS

| | | |
|---|---|---|
| EP | 0 896 933 A2 | 2/1999 |
| EP | 1900941 | 3/2008 |
| GB | 2002025 | 2/1979 |
| JP | 3195811 | 8/1991 |
| JP | 6287567 | 10/1994 |
| WO | 2012030682 | 3/2012 |

* cited by examiner

DUCT HAVING OSCILLATORY SIDE WALL

STATEMENT REGARDING GOVERNMENT SUPPORT

This invention was made with government support under Contract No. DE-FC26-04NT42237 awarded by the U.S. Department of Energy. The Government has certain rights in this invention.

BACKGROUND

Coal gasification involves the conversion of coal or other carbon-containing solid particulate into synthesis gas. While both dry coal and water slurry are used in the gasification process, dry coal pumping may be more thermally efficient than water slurry technology.

In order to streamline the process and increase the mechanical efficiency of dry coal gasification, a particulate extrusion pump is utilized to pump pulverized carbon-based fuel, such as dry coal particulate.

SUMMARY

A pump system according to an example of the present disclosure includes a particulate consolidator pump having a pump outlet, a duct coupled to the pump outlet, the duct having a wall, and an oscillator coupled to the wall.

In a further embodiment of any of the foregoing embodiments, the oscillator is operable to oscillate the wall at a controlled frequency.

In a further embodiment of any of the foregoing embodiments, the duct extends along a central axis from a duct inlet at the pump outlet. The wall of the duct is moveable to oscillate along an axis that is parallel to or perpendicular to the central axis.

In a further embodiment of any of the foregoing embodiments, the duct extends along a central axis from a duct inlet at the pump outlet. The duct also has a cross-section perpendicular to the central axis. The cross-section is elongated along an axis perpendicular to the central axis such that the duct has opposed short side walls and opposed long side walls, and the wall that is coupled with the oscillator is one of the opposed short side walls.

In a further embodiment of any of the foregoing embodiments, the duct extends along a central axis from a duct inlet at the pump outlet. The duct also has a cross-section perpendicular to the central axis. The cross-section is elongated in a direction perpendicular to the central axis such that the duct has opposed short side walls and opposed long side walls, and the wall that is coupled with the oscillator is one of the opposed long side walls.

In a further embodiment of any of the foregoing embodiments, the duct extends along a central axis from a duct inlet at the pump outlet. The duct also has a cross-section perpendicular to the central axis. The cross-section is elongated in a direction perpendicular to the central axis such that the duct has opposed short side walls and opposed long side walls, and the oscillator is coupled with at least one of the opposed short side walls and at least one of the opposed long side walls.

In a further embodiment of any of the foregoing embodiments, the opposed short side walls are moveable to oscillate along a first axis and the opposed long side walls are moveable to oscillate along a second axis that is perpendicular to the first axis.

In a further embodiment of any of the foregoing embodiments, the wall is moveably supported on a bearing.

In a further embodiment of any of the foregoing embodiments, the oscillator is operable to oscillate the wall at a controlled frequency. The controlled frequency is selected with respect to breaking static bridging of particulate in the duct due, at least in part, to consolidation of the particulate from a downstream check valve.

In a further embodiment of any of the foregoing embodiments, the duct includes a duct inlet at the pump outlet, a duct outlet downstream of the duct inlet, and a check valve at the duct outlet.

A duct for a pump system according to an example of the present disclosure includes duct extending from a duct inlet to a duct outlet, the duct including a wall, a check valve at the duct outlet operable to restrict flow of a particulate from the duct outlet, and an oscillator coupled with the wall of the duct. The oscillator is operable to oscillate the wall at a controlled frequency with respect to breaking static bridging of particulate in the duct due, at least in part, to consolidation of the particulate from restriction of flow through the check valve.

In a further embodiment of any of the foregoing embodiments, the duct extends along a central axis from the duct inlet, the wall being moveable to oscillate along an axis that is parallel to or perpendicular to the central axis.

In a further embodiment of any of the foregoing embodiments, the wall is moveably supported on a bearing.

A method for a pump system according to an example of the present disclosure includes pumping particulate through a particulate consolidator pump that includes a pump outlet, receiving the particulate from the pump outlet into a duct that has a wall, and oscillating the wall of the duct at a controlled frequency.

A further embodiment of any of the foregoing embodiments includes oscillating the wall at the controlled frequency with respect to breaking static bridging of particulate in the duct due, at least in part, to consolidation of the particulate from restriction of flow through a downstream check valve.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
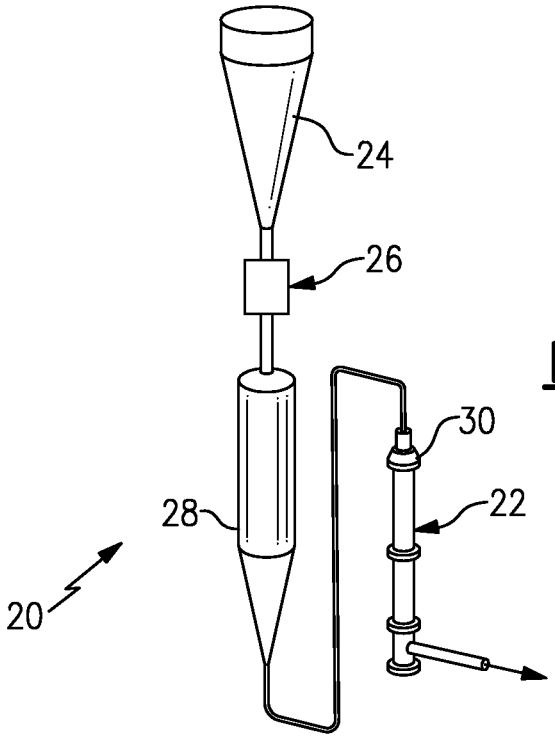
FIG. 1 is an example gasifier system.

FIG. 1 schematically illustrates selected portions of a carbonaceous gasifier system 20 configured for gasification of coal, petcoke or the other carbon-based fuel to produce synthesis gas (also known as "syngas"). In this example, the gasifier system 20 generally includes an entrained-flow gasifier 22, or reactor vessel. The gasifier 22 is connected with a low pressure hopper 24, a pump system 26 and a high pressure tank 28 for providing carbonaceous particulate material to the gasifier 22. Although the pump system 26 is described in context of the gasifier system 22, the pump system 26 as further described herein will also be applicable in other systems to transport other types of particulate material in various industries, such as petrochemical, electrical power, food, and agricultural.

The gasifier 22 includes an injector 30 to receive and inject the carbonaceous particulate material and an oxidant into the interior volume of the gasifier 22. As an example, the injector 30 is an impingement-style, jet injector. The carbonaceous particulate material combusts within the gasifier 22 to produce the syngas, which may then be provided downstream to one or more filters for further processing, as is known.

Figure 2:
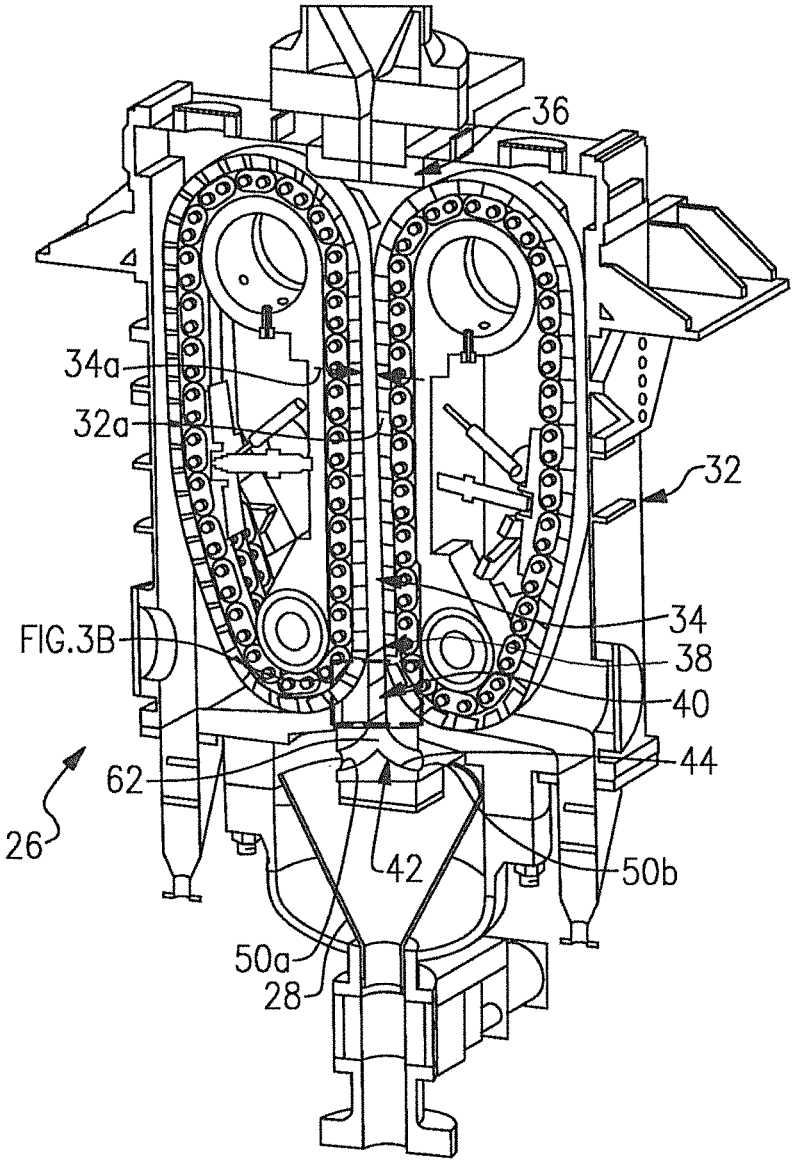
FIG. 2 is an example pump system of the gasifier system.

FIG. 2 shows a sectioned view an example of the pump system 26. The pump system 26 includes a particulate consolidator pump 32 (hereafter "pump 32") that defines a pump passage 34 that extends between a pump inlet 36 and a pump outlet 38. A "particulate consolidator pump" is a pump that is configured to move particulate material from a low pressure environment, such as the low pressure hopper 24, to a high pressure environment, such as the high pressure tank 28. The pump 32 constricts lateral movement of the particulate material and thereby consolidates the particulate material into a densely packed plug that functions as a seal to limit backflow of pressurized gas, although a limited amount of gas may leak through open interstices between the packed particles. The plug acts as a "dynamic seal" that is in continuous motion as the particulate material compacts and replenishes consolidated particulate material that discharges.

The pump passage 34 has a cross-sectional area, as represented by dimension 34*a*, which in this example is substantially constant between the pump inlet 36 and the pump outlet 38 of the particulate pump 32. For example, the cross-sectional area does not vary by more than 10% along the length of the pump passage 34.

In this example, the pump 32 is a moving-wall pump and includes at least one, and in the illustrated example two, moving side walls 32*a* that are moveable along the pump passage 34. For example, each moving wall 32*a* is an endless chain that carries tiles that function as a working surface for moving the particulate through the pump passage 34. The tiles can overlap to provide sealing and limit loss of particulate from the pump passage 34 into the interior areas of the endless chain or other areas within the particulate pump 32.

A duct 40 is coupled at the pump outlet 38 of the pump 32. In this example, the duct 40 includes deconsolidator 42 that is configured to fragment particle agglomerates received from the pump passage 34. That is, the deconsolidator 42 breaks-up agglomerates of particles rather than fracturing individual particles. The duct 40 and/or deconsolidator 42 may be considered to be part of the particulate pump 32 or may be considered to be a separate part from the particulate pump 32.

Figure 3A:
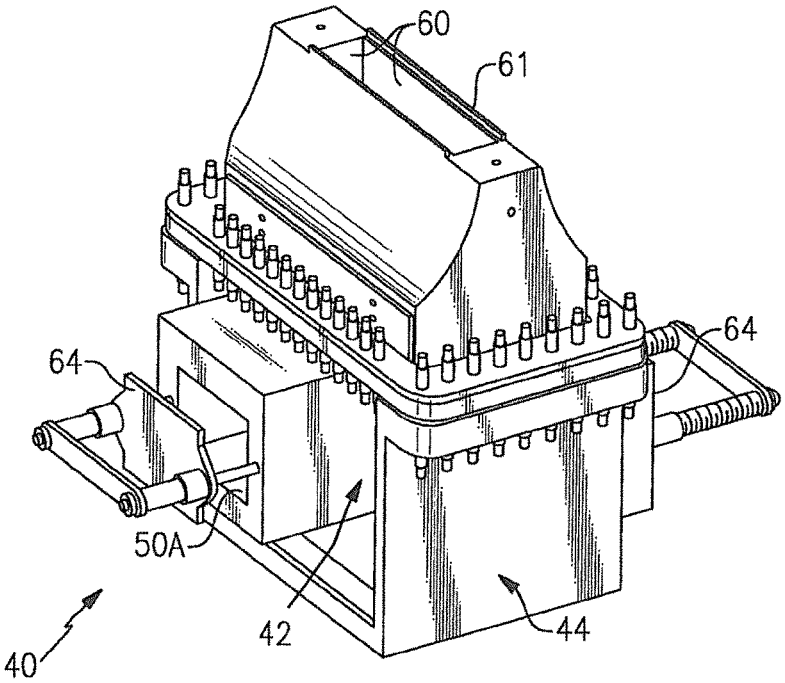
FIG. 3A is an isolated view of a duct of the pump system.
Figure 3B:
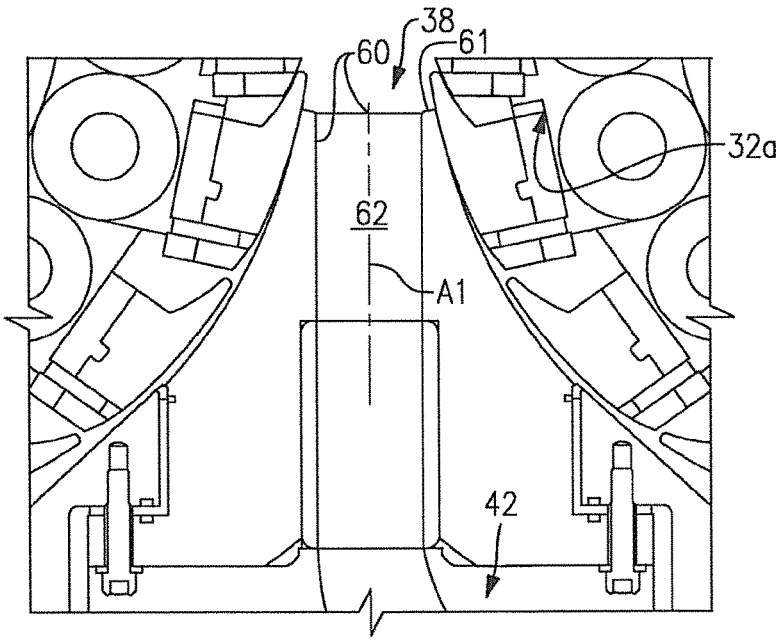
FIG. 3B is a magnified view of a portion of the duct.

FIG. 3A shows an isolated view of the duct 40, including the deconsolidator 42, and FIG. 3B shows a magnified view of a portion of the duct 40 (see area indicated in FIG. 1). The duct 40 includes duct walls 60 that circumscribe a duct passage 62. The duct passage 62 forms a continuation of the pump passage 34 and extends, at least initially, along a central axis A1 from a duct inlet 61 at the pump outlet 38. The duct inlet 61 can also serve as a scraper to facilitate removal of particulate from the moving side walls 32*a* in the transition from the pump passage 34 to the duct passage 62.

The deconsolidator 42 includes a divider 44 that splits the duct passage 62 into multiple sub-passages, which turn laterally from each other in this example, to generate a shear force on the particulate matter and thereby fragment agglomerates. In this example, the sub-passages terminate at respective duct outlets 50*a*/50*b*.

The duct 40 further includes doors 64 (FIG. 3A) that are movable between open and closed positions with respect to the duct outlets 50*a*/50*b*. The doors 64 are passively moveable in response to differential pressure between the particulate flowing at the outlets 50*a*/50*b* and the pressure in the high pressure tank 28, which the outlets 50*a*/50*b* open into. The doors 64 thus serve as check valves for controlling discharge of particulate from the duct 40. As can be appreciated, the geometry of the duct passage 62 can be varied from the illustrated example. In one modified alternative, the duct passage 62 can be an undivided linear or curved passage, and the deconsolidator 42 can be excluded such that the duct passage 62 discharges through a single check valve. Combinations of these geometries with or without the deconsolidator 42, or with or without other handling mechanisms, is also contemplated.

Figure 4:
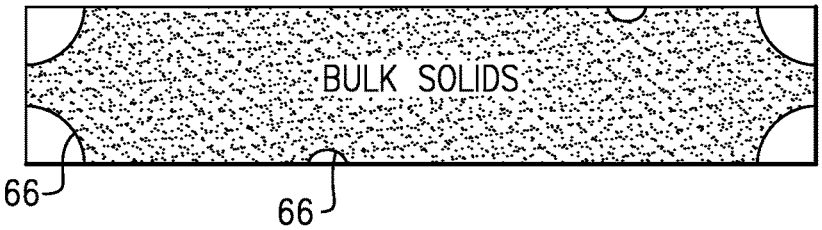
FIG. 4 illustrates a cross-section of a duct having static bridging of particulate.

FIG. 4 illustrates a phenomenon that can occur in a duct passage, due at least in part to restriction of flow of particulate material through a downstream check valve or other flow restriction. The downstream flow restriction causes a back-pressure within the duct passage according to a pressure gradient generally between the outlet of the duct passage and the inlet of the duct passage. If the particulate has a relatively low void volume, a dynamic plug forms, as discussed above, to limit escape of pressurized gas back into the pump. However, forces on the particulate from the back-pressure can amplify up through the duct passage toward the pump passage, particularly at the duct walls where there is friction. The forces can pack the solid particulate and form non-transitory static bridging, as represented at 66 in FIG. 4. The static bridging 66 is an arc-shaped packing of particulate that extends at its ends either between two adjacent walls, such as in a corner of the duct passage, or along the face of one of the walls. In either case, the static bridging 66 can limit local movement of particulate and lead to voids in the corners and/or at the walls of the duct passage. The pump can be operated at off-design conditions to generate higher compressive stresses to reduce static bridging and "squeeze" smaller voids. However, operation to generate the higher compressive stress sacrifices pump efficiency.

As additional voids form, the voids can connect into a void network through which high pressure gas can escape upward through the duct passage toward the pump. If the void network extends back to the pump, the blow-back of high pressure gas into the pump can blow particulate material through gaps in the moveable side walls and into interior areas of the particulate pump, which may hinder pump operation. This also results in a loss of particulate material from the pump passage and duct passage, and further escape of pressurized gas upward through the pump, which is also associated with a loss of pumping efficiency.

Figure 5:
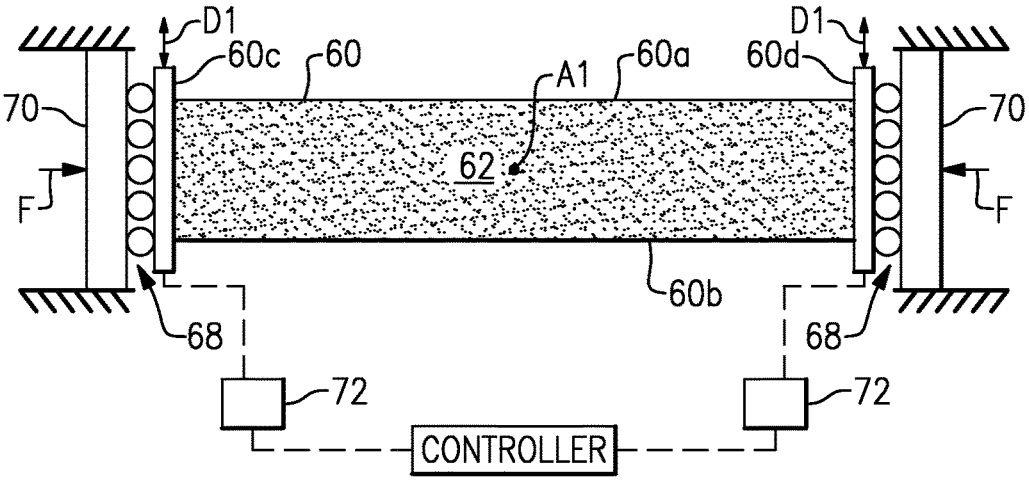
FIG. 5 illustrates a cross-section of a duct having at least one oscillatory side wall.

FIG. 5 illustrates a schematic representation of a cross-section of the duct passage 62 and duct walls 60 that circumscribe the duct passage 62. In this example, the cross-section is taken perpendicular to the central axis A1 along which the duct passage 62 extends from the pump outlet 38.

In this example, the cross-section of the duct passage 62 is rectangular and is elongated in a direction perpendicular to the central axis A1 such that there are two opposed long side walls, represented at 60*a*/60*b*, and two opposed short side walls 60*c*/60*d*.

At least one of the duct walls 60 (collectively side walls 60*a*, 60*b*, 60*c*, and 60*d*) is an oscillatory side wall. In this example, the two opposed short side walls 60*c*/60*d* are oscillatory with regard to cyclic, controlled movement along a direction D1, which is also perpendicular to the central axis A1. Although this example is described with reference to oscillatory short side walls 60*c*/60*d*, it is to be understood that a single one of the side walls 60*c*/60*d* could be oscillatory.

The oscillatory side walls 60*c*/60*d* are supported on respective bearings 68, which are supported by respective support walls 70. The support walls 70 are moveable such that a force, represented at F, can be applied to maintain the oscillatory side walls 60*c*/60*d* in position laterally, yet allow movement in the oscillatory direction D1. The force balances the bulk solids compression load and internal gas pressure on the side walls 60*c*/60*d* and can be calculated by integrating the particulate compression load and gas pressure over the area of the side walls 60*c*/60*d*.

Each of the oscillatory side walls 60*c*/60*d* is operably coupled with at least one mechanical oscillator 72. As can be appreciated, each oscillatory side wall 60*c*/60*d* can be connected with an individual mechanical oscillator 72 or, alternatively, operated through a common mechanical oscillator 72. The mechanical oscillator or oscillators 72 can also be operably connected with a controller that is configured with hardware, such as a microprocessor, software, or both, to control operation thereof and thus control oscillation of the oscillatory side walls 60*c*/60*d*.

The oscillatory side walls 60*c*/60*d* can be oscillated at a controlled frequency and/or amplitude along oscillatory direction D1. The oscillation of the side walls 60*c*/60*d* destabilizes any static bridging that initiates and thus limits, reduces, or even eliminates static bridging that can lead to void networks and blowback of pressurized gas through the duct passage 62. For example, the controlled frequency at which the side walls 60*c*/60*d* are oscillated can be selected with respect to breaking any static bridging that occurs due, at least in part, to consolidation of the particulate from the downstream check valves. As an example, the oscillatory side walls 60*c*/60*d* can be oscillated at a controlled amplitude of approximately 1.6 millimeters and a controlled frequency of approximately 60 Hz, although it is to be understood that the amplitude and frequency may depend on the particulate and geometry of the duct passage 62.

Since the gas and compressive particulate loads acting on the side walls 60*c*/60*d* are balanced by the applied force F, the force, $\tilde{F}_{vib}$, applied to each of the side walls 60*c*/60*d* may be dominated by the mass of the side walls 60*c*/60*d* ($W_{ep}$), oscillation amplitude ($A_{OSC}$), and frequency of oscillation ($f_{OSC}$) since friction loading from the stationary scraper walls will be minimal. The resultant force acting on the side walls 60*c*/60*d* can be represented:

$$\tilde{F}_{vib}=W_{ep}A_{OSC}(2\pi f_{OSC})^2 \sin(2\pi f_{OSC}t),$$

where the variable t is time. If assuming that any static bridging can be broken with a nominal oscillation amplitude $A_{OSC}$ of approximately 1.6 millimeters and a oscillation frequency $f_{OSC}$ of 60-Hertz, using side walls 60*c*/60*d* having a nominal mass of 10-lbm each will require an oscillation load that has a peak force according to the equation above of 230-lbf, or a nominal root-mean-square (rms) value of 163-lbf.

Additionally, since the side walls 60*c*/60*d* frictional loads in the horizontal direction should be negligible for properly balanced side walls 60*c*/60*d* (where $F_{com}$ is equal to the integrated gas and bulk solids compression loads), then the applied force $\tilde{F}_{OSC}$ should be 90 degrees out of phase with the side walls 60*c*/60*d* oscillatory horizontal velocity. This means that the electrical power consumption required to drive the horizontal oscillation should be negligible in comparison to the electrical power required to drive the pump moveable side walls 32*a*. Further, the pump 32 does not have to consume excess power in order to eliminate static bridges/voids, and the electrical power consumed by the mechanical oscillators 72 will be relatively small in comparison to the power consumption of the drive motors used to drive the moveable walls 32*a*. Without being bound, this is because providing unstable bridging foundations at side walls 60*c*/60*d* is more efficient than trying to "squeeze" the voids shut by loading the bridges with more consolidation compressive stresses from the pump 32.

Figure 6:
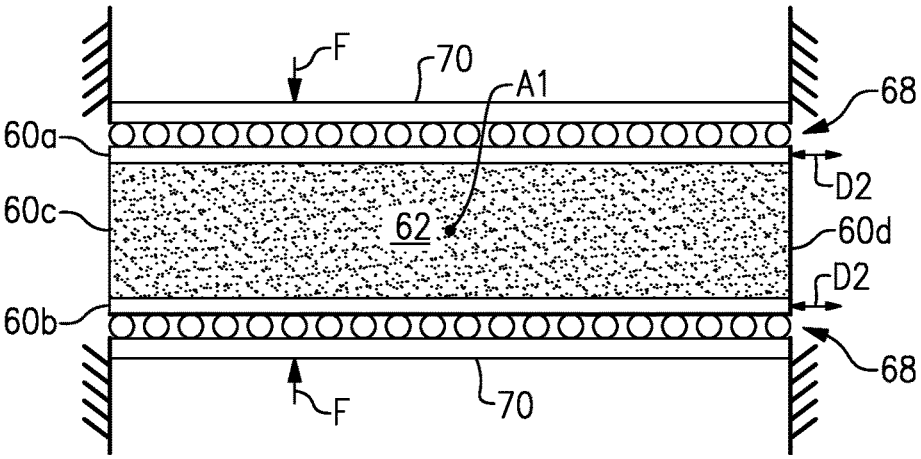
FIG. 6 illustrates another example of a duct having oscillatory long side walls.

In a modified example illustrated in FIG. 6, rather than having the opposed short side walls 60*c*/60*d* be oscillatory, the opposed long side walls 60*a*/60*b* are oscillatory and the short side walls 60*c*/60*d* are static. Thus, in this example, the oscillatory opposed long side walls 60*a*/60*b* can oscillate along direction D2, which is also perpendicular to central axis A1 of the duct passage 62.

Figure 7:
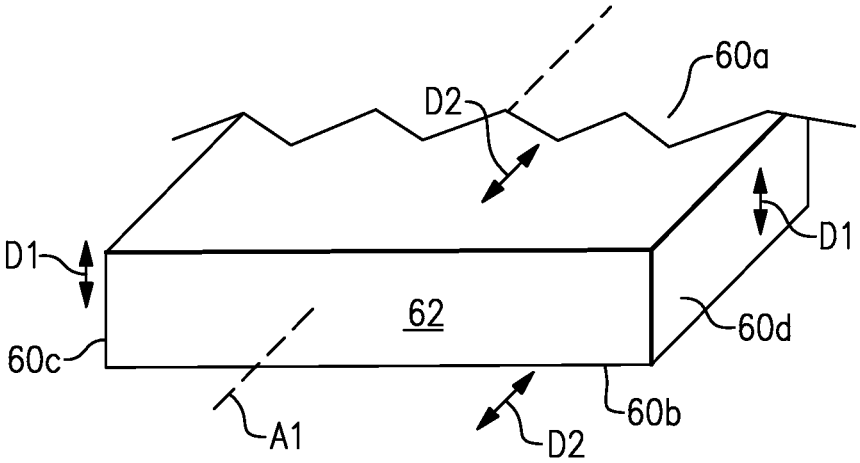
FIG. 7 illustrates another example of a duct that has four oscillatory side walls.

In another modified example shown in FIG. 7, the duct walls 60*a*, 60*b*, 60*c*, and 60*d* are shown schematically with respect to the duct passage 62. In this example, the opposed long side walls 60*a*/60*b* and the opposed short side walls 60*c*/60*d* are all oscillatory such that the opposed long side walls 60*a*/60*b* are oscillatory along direction D2, which in this case is parallel to central axis A1, while the short side walls 60*c*/60*d* are oscillatory along direction D1 that is perpendicular to the central axis A1 and perpendicular to the direction D2. Thus, all sides of the duct passage 62 can be oscillated to further reduce or limit any static bridging that initiates.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A pump system comprising:

a particulate consolidator pump having a pump outlet;

a duct coupled to the pump outlet, the duct having a wall, the duct and the wall extending along a central axis from a duct inlet at the pump outlet, the wall of the duct being moveable to oscillate along an axis that is parallel to or perpendicular to the central axis;

an oscillator directly coupled to the wall, and being operable to oscillate the wall at a controlled frequency; and a deconsolidator downstream of the pump outlet, wherein the deconsolidator is configured to fragment particle agglomerates received from the pump outlet, the duct wall connects the pump outlet to the deconsolidator, and the oscillator is coupled to the wall between the pump outlet and the deconsolidator.

2. The pump system as recited in claim 1, wherein the wall is directly coupled to the pump outlet.

3. The pump system as recited in claim 2, wherein the wall extends parallel to the central axis.

4. The pump system as recited in claim 1, the duct also having a cross-section perpendicular to the central axis, the cross-section being elongated along an axis perpendicular to the central axis such that the duct has opposed short side walls and opposed long side walls.

5. The pump system as recited in claim 1, the controlled frequency selected with respect to breaking static bridging of particulate in the duct due, at least in part, to consolidation of the particulate from a downstream check valve.

6. The pump system as recited in claim 1, the duct including the duct inlet at the pump outlet, a duct outlet downstream of the duct inlet, and a check valve at the duct outlet.

7. The pump system as recited in claim 6, the duct inlet and duct outlet each positioned on the central axis.

8. The pump system as recited in claim 1, wherein the deconsolidator comprises a divider that splits a duct passage into more than one sub-passage.

9. The pump system as recited in claim 8, wherein the more than one sub-passage turn laterally from each other.

10. The pump system as recited in claim 1, the oscillator being operable to oscillate the wall to destabilize static bridging of particulate within the duct.

11. The pump system as recited in claim 10, wherein the wall is directly coupled to the pump outlet.

12. The pump system as recited in claim 10, wherein the wall extends parallel to the central axis.

13. The pump system as recited in claim 1, wherein the pump comprises a pump passage that extends along the central axis, and the duct comprises a duct passage that is a continuation of the pump passage from the pump outlet, wherein the duct passage also extends along the central axis.

14. The pump system as recited in claim 13, wherein the wall is directly coupled to the pump outlet.

15. The pump system as recited in claim 13, wherein the wall extends parallel to the central axis.

* * * * *